US005101881A

United States Patent [19]

Hunter

[11] Patent Number: 5,101,881

[45] Date of Patent: Apr. 7, 1992

[54] QUICK-CHANGE MATCHPLATE SYSTEM FOR MATCHPLATE MOLDING MACHINE

[75] Inventor: William A. Hunter, Naples, Fla.

[73] Assignee: Hunter Automated Machinery Corporation, Schaumburg, Ill.

[21] Appl. No.: 686,236

[22] Filed: Apr. 16, 1991

[51] Int. Cl.[5] ..... B22C 7/04; B22C 21/08

[52] U.S. Cl. ..... 164/239; 164/374

[58] Field of Search ..... 164/235-244, 164/374, 182, 187

[56] References Cited

U.S. PATENT DOCUMENTS

| | | | |
|---|---|---|---|
| 1,093,439 | 4/1914 | Lang | 164/182 |
| 2,894,299 | 7/1959 | Buhrer | 164/239 |
| 4,463,794 | 8/1984 | Shioda | 164/182 |
| 4,553,581 | 11/1985 | Uppgren et al. | 164/243 X |
| 4,673,020 | 6/1987 | Hatch | 164/127 X |
| 4,830,082 | 5/1989 | Bellis et al. | 164/158 X |
| 4,840,218 | 6/1989 | Hunter | 164/187 X |

FOREIGN PATENT DOCUMENTS

| | | | |
|---|---|---|---|
| 1280497 | 10/1968 | Fed. Rep. of Germany | 164/237 |

*Primary Examiner*—J. Reed Batten, Jr.
*Attorney, Agent, or Firm*—Leydig, Voit & Mayer

[57] ABSTRACT

The pattern plate of a matchplate molding machine is attached to a drag flask by spring-loaded clamps which may be rapidly opened to enable the plate to be quickly and easily removed from the flask and replaced by another plate. Locating members are attached to the flask in laterally opposed relation with the clamps and coact with the clamps to fixture the pattern plate accurately on the flask. A removable operating handle is provided for opening the clamps and carries a latch for releasably holding the clamps in their open positions during changing of the pattern plates.

16 Claims, 5 Drawing Sheets

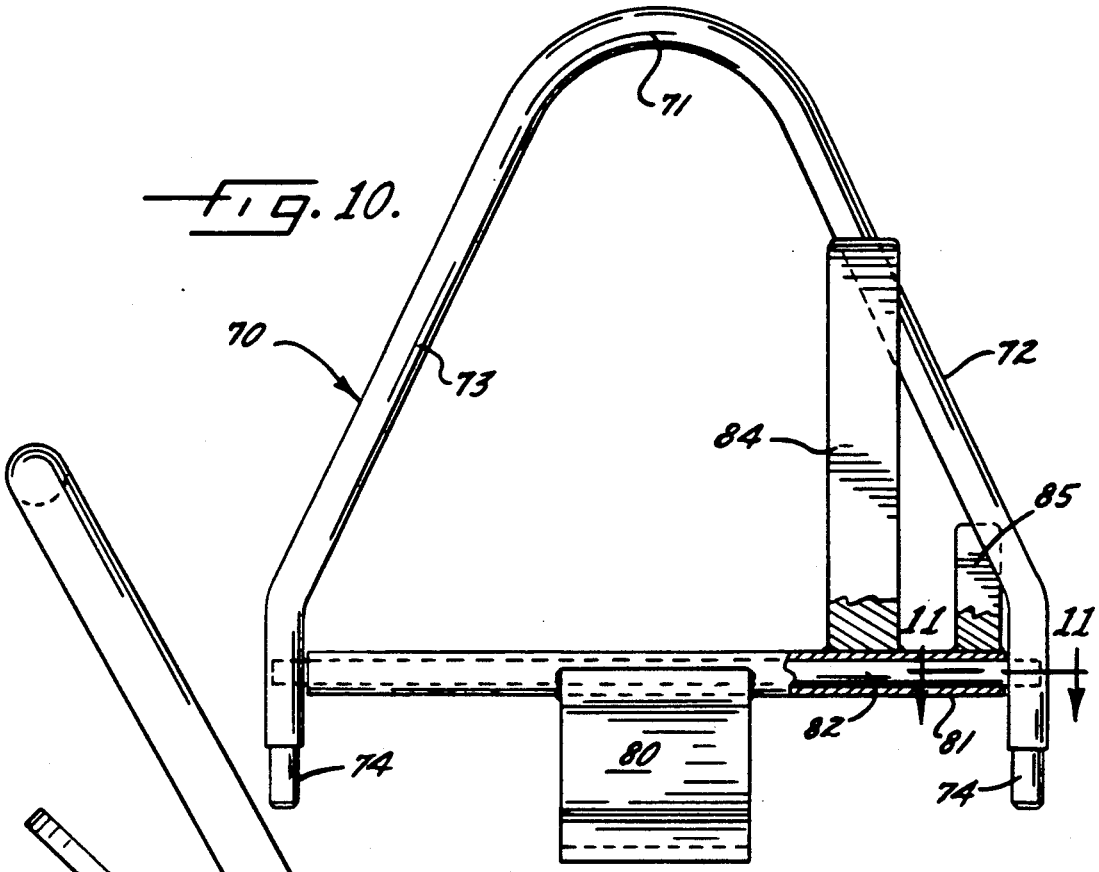
Fig. 10.
Fig. 11.
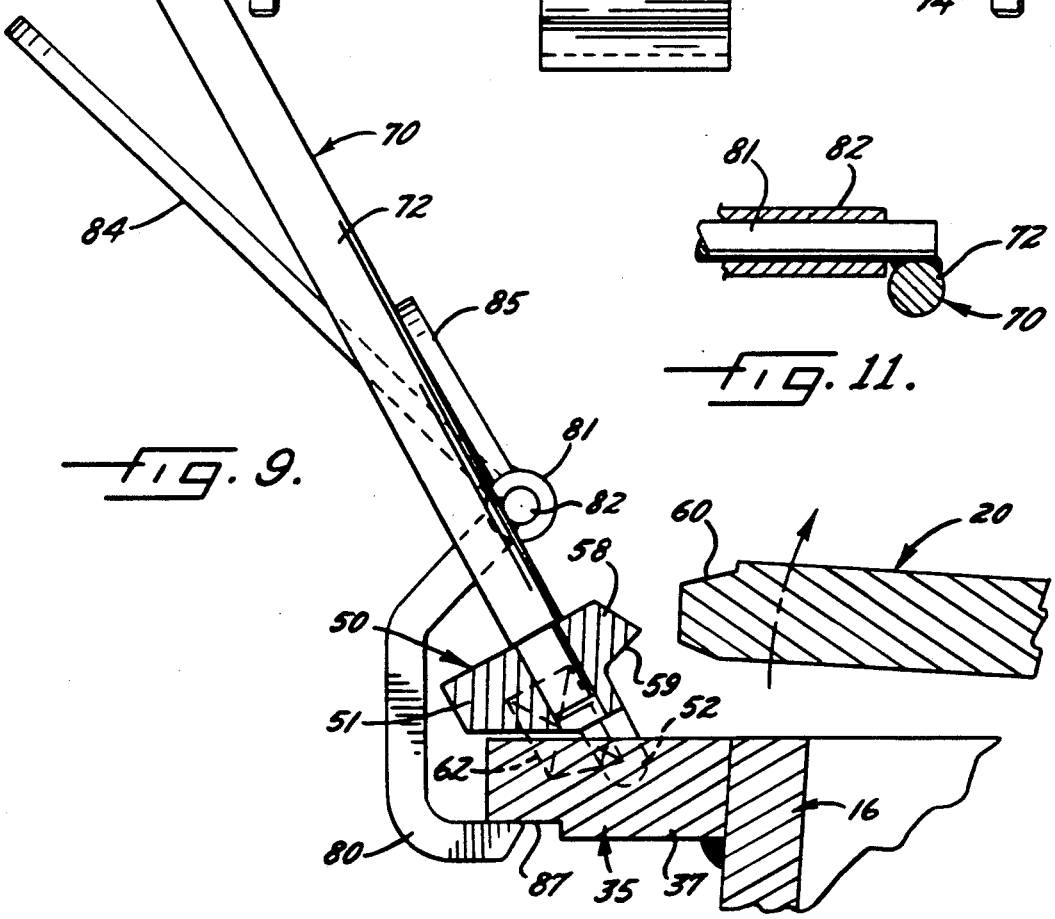
Fig. 9.

QUICK-CHANGE MATCHPLATE SYSTEM FOR MATCHPLATE MOLDING MACHINE

BACKGROUND OF THE INVENTION

This invention relates to the art of molding machines and more particularly to automatic matchplate molding machines of the type in which a pattern plate is located between cope and drag flasks adapted to be filled with sand and adapted to be rammed upwardly toward a squeeze head in order to pack the sand and form mold cavities in the sand in the flasks. A machine of this general type is disclosed in Hunter U.S. Pat. No. 4,840,218.

The pattern plate of such a machine carries oppositely projecting cope and drag patterns which form mold cavities in the cope and drag molds, respectively. Conventionally, the pattern plate is fastened by bolts to a peripheral flange which extends around the upper end of the drag flask. In order to replace the pattern plate with a plate having differently shaped patterns, it is necessary to remove the bolts and the pattern plate, install the new pattern plate and then re-install the bolts. Removal and re-installation of the bolts is laborious and is very time-consuming. When a large number of pattern plates is changed on a frequent basis, the change-over operation is labor intensive and thus is costly.

SUMMARY OF THE INVENTION

The general aim of the present invention is to provide a new and improved system for attaching pattern plates to molding flasks and enabling the plates to be changed significantly more quickly and easily than has been possible heretofore.

A more detailed object of the invention is to achieve the foregoing through the provision of clamps which normally coact with locators to hold a pattern plate in a fixtured position on a flask and which may be selectively opened to enable the pattern plate to be quickly removed from the flask and replaced with a different plate.

Another object is to provide a removable operating handle enabling the clamps to be quickly opened and operable to latch the clamps in their open positions during changing of the pattern plate.

The invention also resides in the provision of unique means for enabling existing pattern plates to be converted for use with the quick-change pattern system.

These and other objects and advantages of the invention will become more apparent from the following detailed description when taken in conjunction with the accompanying drawings.

BRIEF DESCRIPTION OF THE DRAWINGS

FIGS. 8 and 9 are views similar to FIGS. 6 and 7, respectively, but show the clamps in their open positions.

FIG. 10 is an elevational view of the clamp operating handle.

FIG. 11 is a fragmentary cross-section taken substantially along the line 11—11 of FIG. 10.

DETAILED DESCRIPTION OF THE PREFERRED EMBODIMENT

Figure 1:
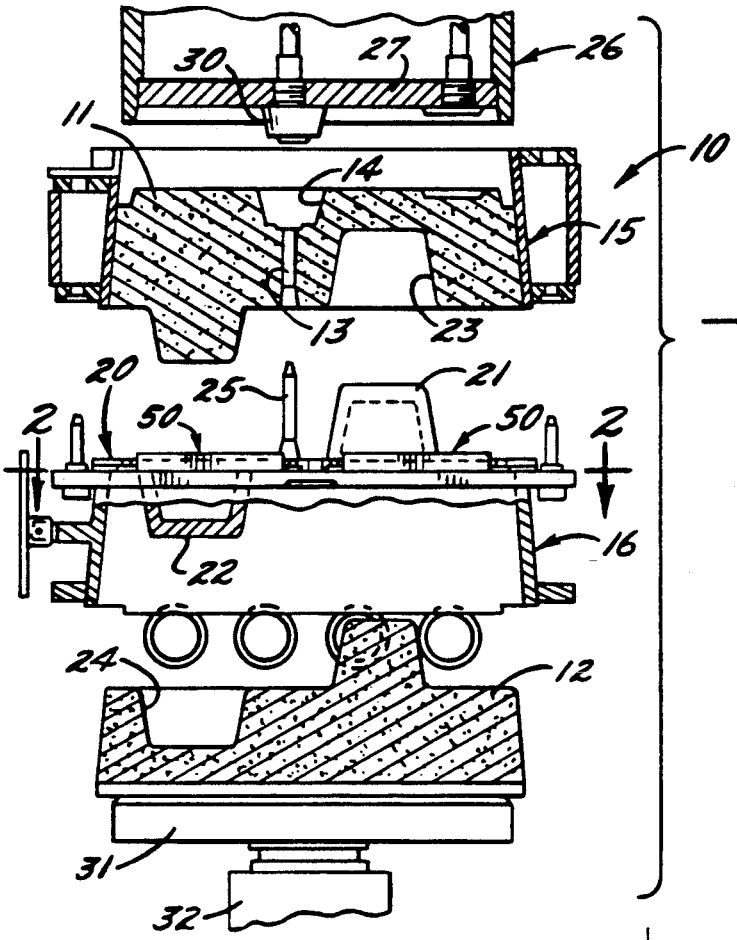
FIG. 1 is a somewhat schematic vertical cross-sectional view of the squeeze heads, the molding flasks and the pattern plate of a typical matchplate molding machine having a drag flask equipped with a new and improved quick-change pattern system incorporating the unique features of the present invention.

For purposes of illustration, the invention has been shown in the drawings in conjunction with a matchplate molding machine 10 for making green sand molds of the type used by foundries to form metal castings. An overall mold typically includes an upper cope mold 11 and a lower drag mold 12 which eventually abut one another to define a cavity having the shape of the part to be cast. Molten metal is introduced into the cavity through a vertically extending sprue 13 formed in the cope mold. To facilitate pouring of the metal into the sprue 13, an enlarged pouring basin 14 is formed in the upper side of the cope mold adjacent the upper end of the sprue.

The machine 10 includes cope and drag flasks 15 and 16 in which the cope and drag molds 11 and 12, respectively, are formed. A pattern plate or matchplate plate 20 is adapted to be located between the flasks 15 and 16 and carries cope and drag patterns 21 and 22 which act to form cavities 23 and 24 in the ultimate molds. The upper side of the matchplate 20 carries a vertically extending sprue former 25 which effects formation of the sprue 13 in the cope mold 11.

Located above the cope flask 15 is a vertically fixed squeeze head 26 having a lower horizontal squeeze plate 27 whose lower side carries a basin former 30. The latter is aligned vertically with the sprue former 25 and serves to create the pour basin 14 in the upper side of the cope mold 11.

FIG. 1 shows the various components of the machine 10 in the positions such components occupy after the cope and drag molds 11 and 12 have been formed and just after the molds have been separated from the matchplate 20. In this position, the drag mold 12 has been lowered from the drag flask 16 and rests on a lower squeeze head 31 which is adapted to be moved vertically by a reciprocating hydraulic actuator 32. Formation of the molds 11 and 12 is effected by filling the flasks 15 and 16 with sand and by moving the lower squeeze head 31 upwardly. As explained in detail in Hunter U.S. Pat. No. 4,840,218, the disclosure of which is incorporated herein by reference, this results in the sand in the drag flask 16 being compacted between the lower squeeze head 31 and the lower side of the matchplate 20 and results in the sand in the cope flask 15 being compacted between the upper side of the matchplate and the lower side of the squeeze plate 27 of the upper squeeze head 26. During such compaction, the pattern 21 and the sprue former 25 create the cavity 23 and the sprue 13 in the cope mold 11 while the pattern 22 forms the cavity 24 in the drag mold 12.

Figure 2:
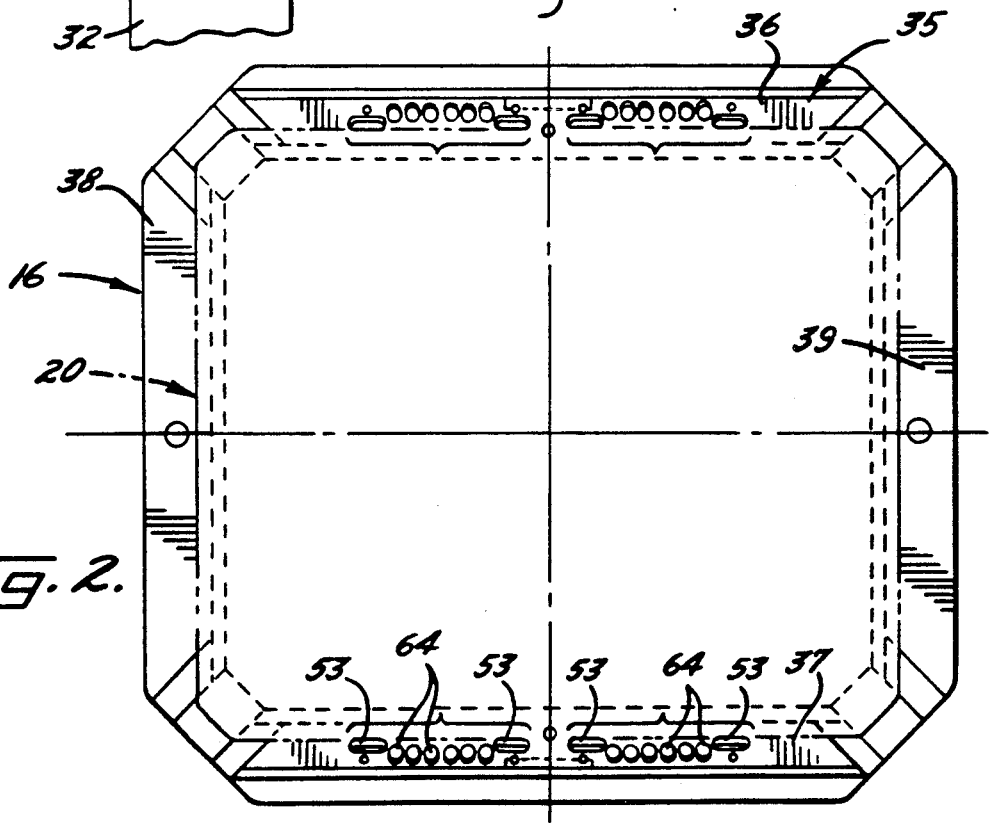
FIG. 2 is an enlarged top plan view of the drag flask of the machine with the pattern plate removed and as seen substantially along the line 2—2 of FIG. 1.
Figure 3:
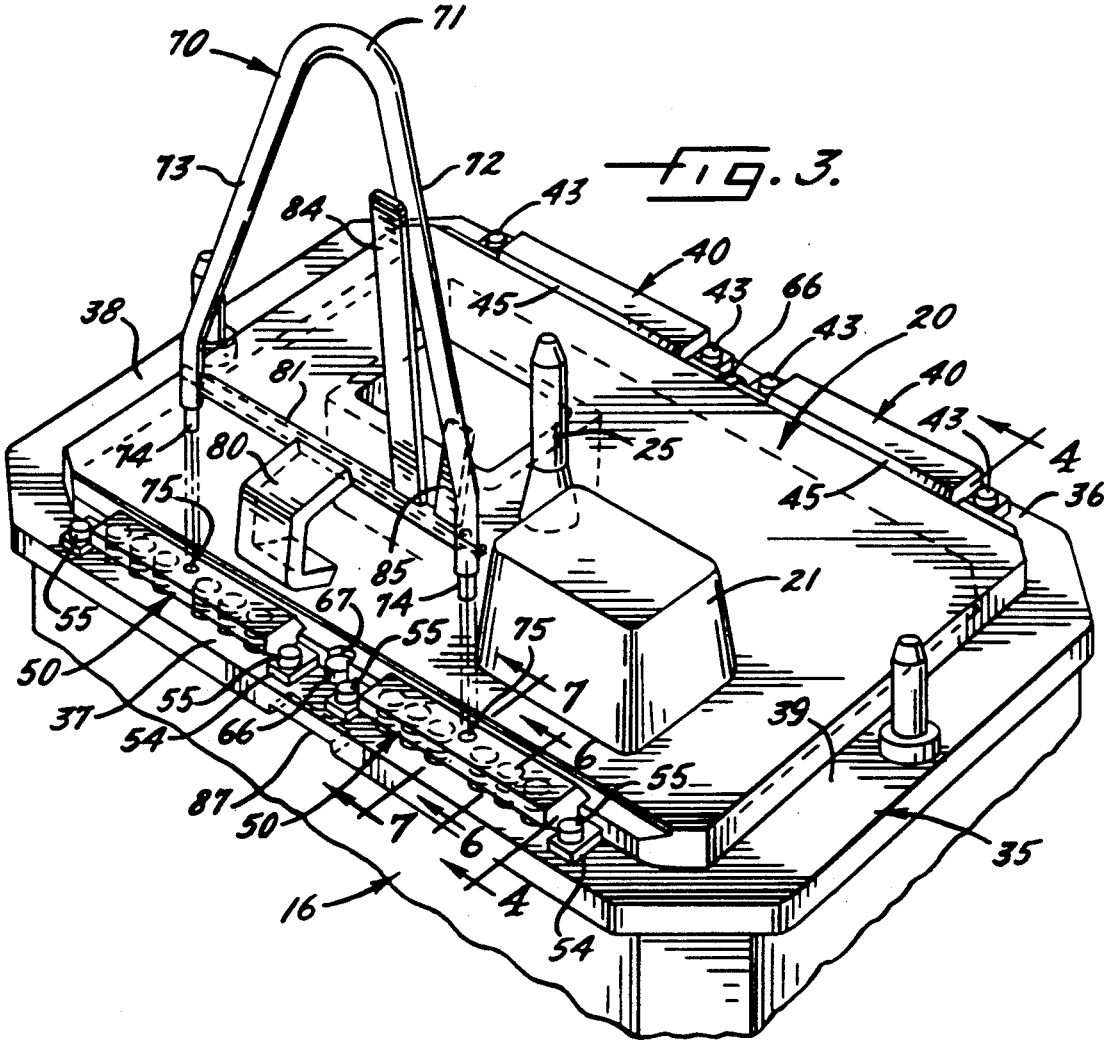
FIG. 3 is a fragmentary perspective view of the drag flask with the pattern plate clamped in place and showing the clamp operating handle in exploded relation.

The drag flask 16 is generally rectangular in shape and includes an open upper end with an outwardly projecting peripheral flange 35 (FIGS. 2 and 3) having two long, parallel and longitudinally extending sides 36 and 37 and two shorter parallel sides 38 and 39 which extend laterally. The matchplate 20 also is generally rectangular and is adapted to be removably attached to the top side of the flange 35. After a certain number of molds of a given type have been formed, the matchplate is removed from the drag flask 16 and is replaced with a different matchplate having differently shaped patterns 21 and 22.

In accordance with the present invention, the time required for changing over the matchplates 20 is significantly reduced through the provision of a unique quick-change clamping system which eliminates the need for removing and re-installing bolts or other fasteners of the type previously used to attach a matchplate to a drag flask. The quick-change system of the invention usually reduces the changeover time to less than one minute and enables the mold making machine 10 to perform short run work at a lower cost per mold.

Figure 4:
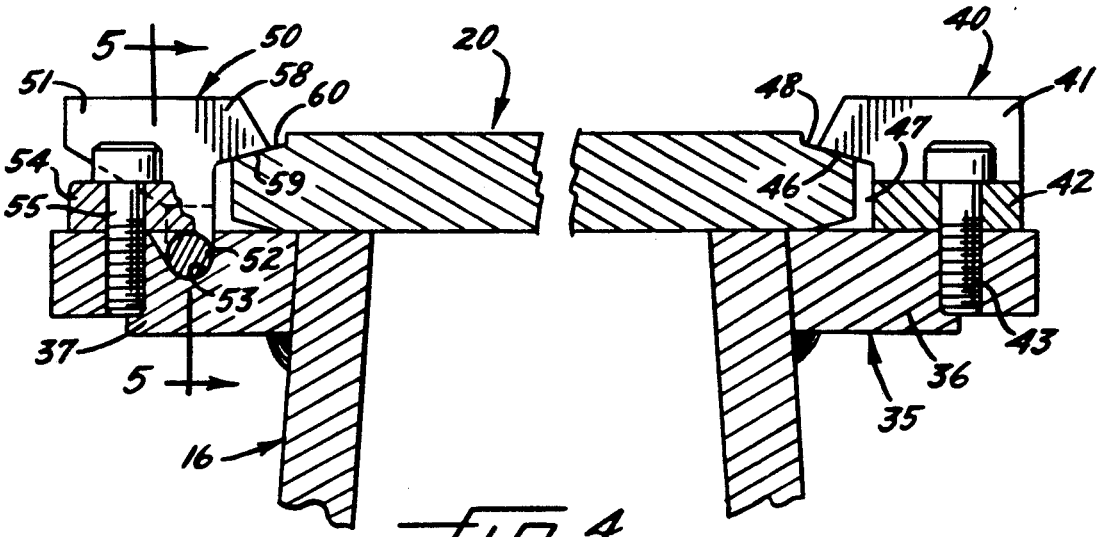
FIG. 4 is an enlarged fragmentary cross-section taken substantially along the line 4—4 of FIG. 3.

More specifically, locating members 40 (FIGS. 3 and 4) are attached to the upper surface of the long side 36 of the flange 35 of the drag flask 16. Preferably, two locating members are spaced from one another along the long side 36 of the flange. Herein, each locating member is in the form of a bar 41 (FIG. 4) whose ends are formed with mounting ears 42 which receive screws 43 for attaching the bar to the flange 35. Formed integrally with and projecting inwardly from each bar 40 is a nose 45 whose lower surface 46 is spaced upwardly from the upper surface of the flange 35 and coacts therewith to define a channel 47 for receiving one side margin of the matchplate 20. The lower surface 46 of the nose 45 and the upper surface 48 of the adjacent side margin of the matchplate 20 are inclined as shown in FIG. 4 and wedge against one another when the matchplate is shifted edgewise toward the nose. Such wedging accurately locates the matchplate in a precise lateral position on the flask 16.

Figure 5:
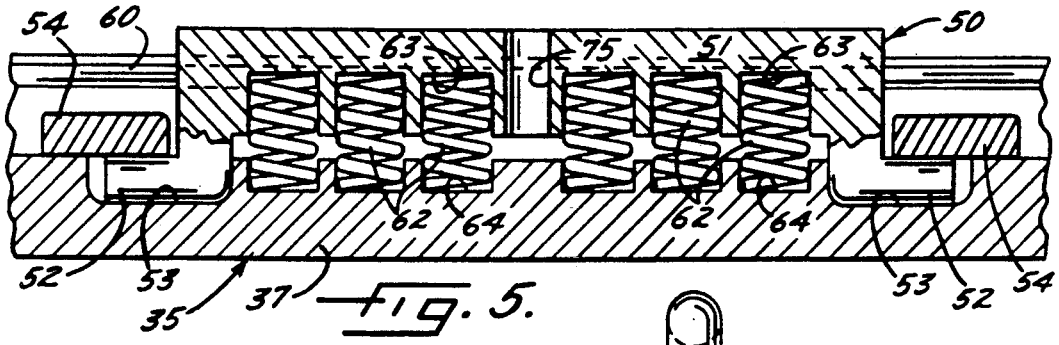
FIG. 5 is a fragmentary cross-section taken substantially along the line 5—5 of FIG. 4.
Figure 6:
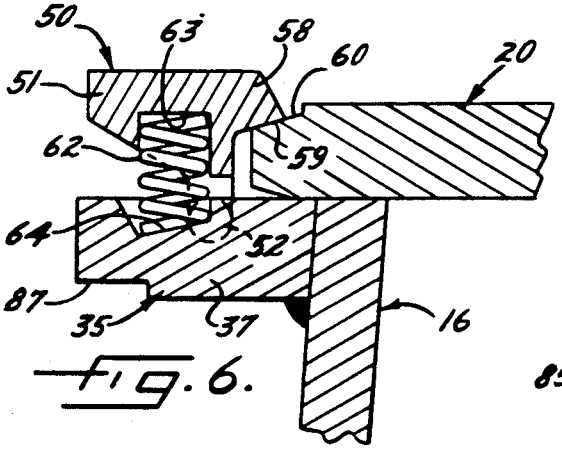
FIGS. 6 and 7 are enlarged fragmentary cross-sections taken substantially along the lines 6—6 and 7—7 of FIG. 3 and showing the clamps in their closed positions.

In carrying out the invention, selectively releasable clamps 50 are located on the upper surface of the long side 37 of the flange 35 of the drag flask 16 and coact with the locating members 40 to clamp the matchplate 20 to the flask. In this instance, there are two clamps 50 spaced longitudinally along the long side 37 of the flange in laterally opposed relation with the locating members 40. Each clamp includes a jaw 51 (FIGS. 4 and 5) whose ends are formed with longitudinally extending trunnions 52 located adjacent the lower side of the jaw. The two trunnions 52 of each clamp are rotatably received in upwardly opening recesses 53 formed in the top of the flange 35 and are retained in the recesses by blocks 54 which are fastened to the flange by screws 55 (FIG. 4). By virtue of the trunnions, each clamp is supported to pivot about a horizontal axis from a closed position shown in FIG. 6 to an open position shown in FIG. 8.

Each clamp 50 includes an inwardly extending nose 58 similar to the noses 45 of the locating members 40 and spaced upwardly from the top of the long side 37 of the flange 35. The lower surface 59 of each nose is inclined and is adapted to engage a similarly inclined upper surface 60 on the adjacent side margin of the matchplate 20.

Means are provided for biasing each clamp 50 to and holding each clamp releasably in its closed position. Herein, these means comprise several (e.g., six) coiled compression springs 62 (FIGS. 5 and 6) spaced longitudinally along each clamp and interposed between the clamp and the flange 35 of the flask 16. The springs are seated in downwardly opening holes or sockets 63 formed in the lower side of the clamp and in upwardly opening sockets 64 formed in the top of the long side 37 of the flange 35. The springs are located laterally outwardly of the axes of the trunnions 52 and thus urge the clamps to their closed positions.

When the clamps 50 are closed, their inclined surfaces 59 engage the inclined surface 60 of the adjacent margin of the matchplate 20 and clamp the latter tightly to the flange 35. Engagement of the inclined surfaces 59 with the inclined surface 60 tends to crowd the matchplate edgewise to force the opposite inclined surface 48 of the matchplate into wedging engagement with the inclined surfaces 46 of the locating members 40 and thereby effect lateral location of the matchplate. The matchplate is fixed in the longitudinal direction by locating pins 66 (FIG. 3) which project vertically from the flange 35, there being one locating pin between the two clamps 50 and another pin between the two locating members 40. The pins 66 fit closely within laterally opening notches 67 formed in the side margins of the matchplate.

Figure 8:
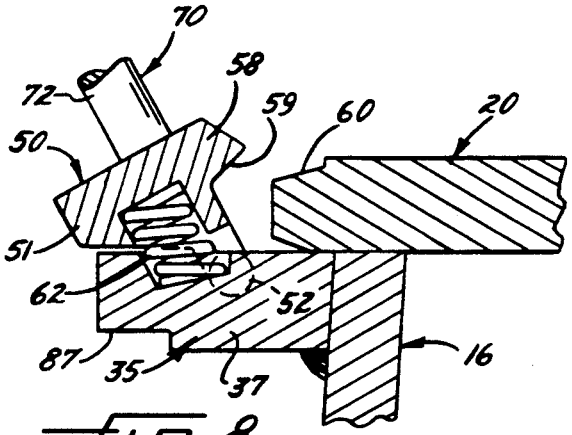

To remove the matchplate 20, the clamps 50 are pivoted to and are held in their open positions shown in FIGS. 8 and 9. Thereafter, the adjacent edge portion of the matchplate is grabbed and lifted as shown in FIG. 9 while simultaneously being shifted edgewise toward the clamps. Such shifting slides the opposite side margin of the matchplate to be lifted off of the flask 16. Installation of a new matchplate is effected by a reverse procedure. That is, the new matchplate is held in a slightly tilted position as shown in FIG. 9 and is shifted edgewise toward the locating members 40 while being lowered. The clamps 50 then are released to move to their closed positions and lock the plate tightly against the long side 37 of the flange 35 under the urging of the springs 62.

Advantageously, means are provided for moving the clamps 50 to and holding the clamps in their open positions, such means being removable from the clamps when the clamps are closed so as to avoid interfering with movement of the drag flask 16 in the mold making machine 10. Herein, these means comprise an operating member in the form of a generally U-shaped handle 70 made of steel rod and having a bight 71 and two legs 72 and 73 with reduced diameter end portions 74. The two end portions 74 of the handle are adapted to telescope with a close but slidable fit into holes 75 (FIGS. 3, 5 and 7) formed in the two clamps 50. By grabbing and pulling outwardly and downwardly on the bight 71 of the handle 70, the clamps 50 may be pivoted against the substantial force of the springs 62 and swung to their open positions. After the new matchplate 20 has been installed and the clamps 50 closed, the handle 70 may be removed from the clamps by pulling the end portions 74 out of the holes 75. As a result, the flask 16 is free to move in the machine 10 without being encumbered by the handle.

Figure 7:
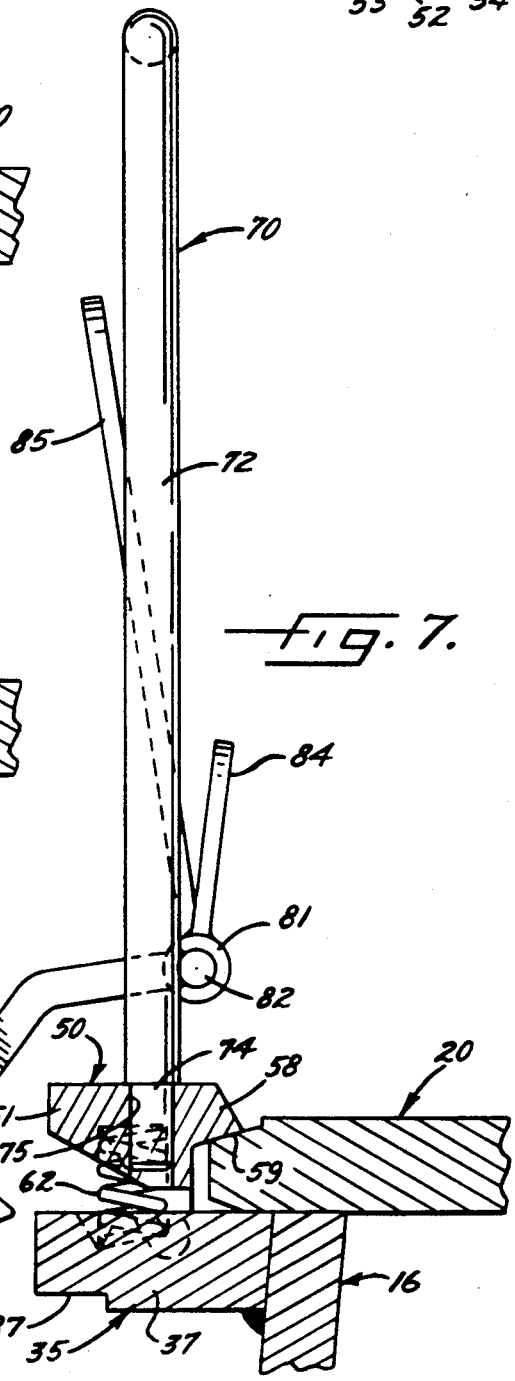

In order to hold the clamps 50 in their open positions during changing of the matchplate 20, the handle 70 carries a latch 80. As shown in FIGS. 7 and 10, the latch is a hook-like member which is attached midway along the length of a sleeve 81 that extends transversely of the legs 72 and 73 of the handle near the end portions 74 thereof. The sleeve is supported to turn on a transversely extending rod 82 whose end portions are secured to the legs of the handle. The sleeve enables the latch to turn between latched and unlatched positions with respect to the handle. A long stop arm 84 and a short stop arm 85 are secured to and project radially from the sleeve near the leg 72 of the handle.

When the handle 70 is swung outwardly and downwardly to open the clamps 50, the leg 72 engages the long stop arm 85 and causes the latch 80 to move in unison with the handle. When the clamps are fully open, the latch swings into a notch 87 (FIGS. 7 and 9) formed in the underside of the flange 35 between the two clamps. As outward and downward pressure on the handle is released, the springs 62 acting through the clamps and the handle cause the latch to hook into the notch 87 and bear tightly against the underside of the flange 35. The handle 70 swings upwardly and inwardly through just a very short distance and then is stopped by virtue of the leg 72 engaging the short stop arm 85. In this way, the latch prevents upward and inward movement of the handle and thus holds the clamps 50 in their open positions as the matchplate 20 is changed. Once the new matchplate has been located on the flask 16, the latch is released by pulling the handle downwardly and outwardly and, at the same time, by pushing upwardly and inwardly on the long arm 84 to pivot the latch out of the notch 87. The springs 62 then swing the clamps to their closed positions, after which the handle may be removed.

From the foregoing, it will be apparent that the present invention brings to the art a new and improved system in which clamps 50 lock a matchplate 20 to a flask 16 and may be rapidly opened to permit quick and easy changing of the matchplate. The clamps coact with the locating members 40 and the locating pins 43 to provide accurate fixturing of the matchplate on the flask. The removable handle 70 facilitates opening of the clamps without permanently encumbering the flask while the latch 80 holds the clamps in their open positions during removal of the old matchplate and installation of the new matchplate.

Figure 12:
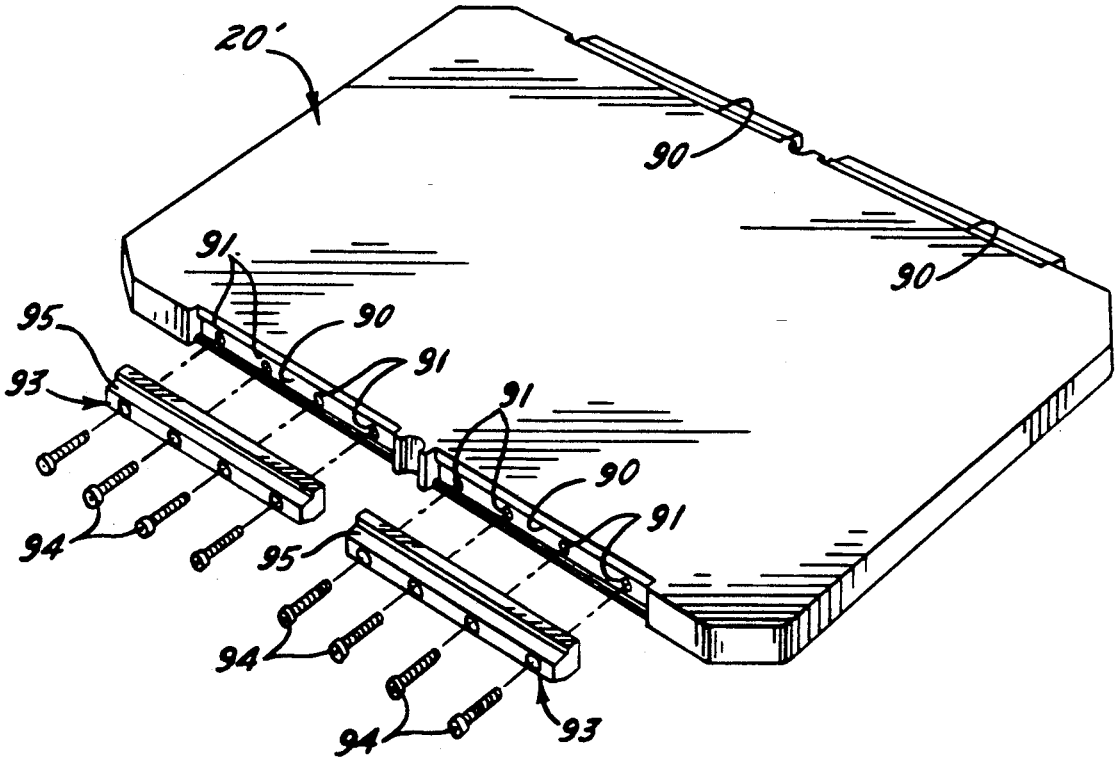
FIG. 12 is an exploded perspective view showing an existing pattern plate converted for use with the quick-change system of the invention.

FIG. 12 shows a conventional bolt-on matchplate 20' which has been converted for use with the quick-change system of the present invention. To effect the conversion, two longitudinally spaced notches 90 are milled in each longitudinally extending side of the matchplate. Several longitudinally spaced holes 91 then are drilled into the matchplate in the bottom of each notch. Bars 93 are seated in the notches and are attached to the matchplate by screws 94 threaded into the holes 91. The upper surfaces 95 of the bars are inclined in a manner similar to the inclined surfaces 48 and 60 of the matchplate 20 in order to enable the bars to be complementary with the locating members 40 and the clamps 50.

I claim:

1. A flask adapted to contain sand and adapted to support a generally rectangular pattern plate for forming a molding cavity in the sand, said flask having an open end, said flask being generally rectangular and having a peripheral flange around its open end, said flange having a first side and having a second and generally parallel second side spaced across said flask from said first side, a locating member fixed to and disposed in spaced opposing relation with said first side of said flange and coacting with said flange to define a channel for receiving one side margin of said pattern plate and for captivating said one margin against said flange, a clamp on the second side of said flange and mounted to pivot between open and closed positions relative to said flange, said clamp being operable when in said open position to enable the opposite side margin of said pattern plate to be slipped between said clamp and said flange and being operable when in said closed position to clamp said opposite side margin to said flange, spring means acting between said flask and said clamp for releasably holding said clamp in said closed position, and manually operable means enabling said clamp to be moved to said open position against the bias of said spring means.

2. A flask as defined in claim 1 in which said manually operable means include an operating member detachably connected to said clamp and operable when actuated manually to move said clamp to said open position against the bias of said spring means, said operating member being removable from said clamp when said clamp is in said closed position.

3. A flask as defined in claim 2 further including a socket in said clamp, said operating member having a rod sized to telescope slidably into said socket to connect said operating member to said clamp.

4. A flask as defined in claim 2 further including means on said operating member for releasably locking said clamp in said open position.

5. A flask as defined in claim 4 in which said locking means comprise a latch mounted on said operating member to move between latched and unlatched positions.

6. A flask as defined in claim 5 in which said latch is mounted on said operating member to swing between said latched and unlatched positions, said latch hooking against said flask when in said latched position.

7. A flask as defined in claim 1 further including a second locating member fixed to and disposed in spaced opposing relation with said first side of said flange and spaced along said first side from said one locating member, and a pin connected to and projecting from said flask and disposed between said locating members, said pin coacting with said pattern plate to prevent the latter from shifting relative to said flask in a direction parallel to said first and second sides of said flange.

8. A flask as defined in claim 7 further including a second clamp on the second side of said flange and spaced along said second side from said one clamp, said second clamp being movable between open and closed positions relative to said flange, second spring means for biasing said second clamp to and releasably holding said second clamp in its closed position, said manually operable means enabling said second clamp to be moved to its open position against the bias of said second spring means when said first clamp is moved to its open position by said manually operable means.

9. A flask as defined in claim 1 in which said side margins of said pattern plate include inclined surfaces, said locating member and said clamp including sloped surfaces which are complementary with said inclined surfaces and engage said inclined surfaces in face-to-face relation when said pattern plate is clamped against said flange.

10. A flask as defined in claim 9 further including bars detachably secured to said side margins of said pattern plate, said inclined surfaces being on said bars.

11. The combination of, a drag flask adapted to hold sand, and a generally rectangular pattern plate for forming a molding activity in the sand in the flask, said flask having an open upper end, said flask being generally rectangular and having a peripheral flange around its open end, said flange having a first side and having a generally parallel second side spaced laterally across said flask from said first side, two locating members fixed to said flask and spaced from one another along the first side of the flange, said locating members being disposed in upwardly spaced opposing relation with said first side of said flange and defining channels for receiving one side margin of said pattern plate and for captivating said one margin against vertical and lateral movement relative to said flange, a pair of clamps spaced from one another along the second side of said flange, means mounting said clamps on said flask to pivot upwardly from closed positions to open positions relative to said flange, said clamps being operable when in said open positions to enable the opposite side margin of said pattern plate to be placed against said second side of said flange and being operable when in said closed positions to clamp said opposite side margin downwardly against said second side of said flange, springs acting between said clamps and said flask and biasing said clamps to said closed positions, and manually operable means enabling said clamps to be moved simultaneously to said open positions against the bias of said springs.

12. The combination defined in claim 11 further including a socket in each of said clamps, said manually operable means comprising an operating member having rods telescoped removably in said sockets, said operating member being operable when actuated manually to move said clamps simultaneously to said open positions, said operating member being detachable from said clamps by removing said rods from said sockets when said clamps are in said closed positions.

13. The combination defined in claim 12 further including means on said operating member for releasably locking said clamps in said open positions.

14. The combination defined in claim 13 in which said locking means comprise a latch mounted on said operating member to swing between latched and unlatched positions, said latch hooking against said flask when in said latched position.

15. The combination defined in claim 11 further including inclined surfaces at the side margins of said pattern plate, said locating members and said clamps including sloped surfaces which are complementary with said inclined surfaces and engage said inclined surfaces in face-to-face relation when said pattern plate is clamped against said flange.

16. The combination defined in claim 15 further including notches formed in the side margins of said pattern plate, bars received in said notches, means detachably securing said bars to said pattern plate, said inclined surfaces being on said bars.

* * * * *